US007131515B2

(12) United States Patent
Gartsbeyn et al.

(10) Patent No.: US 7,131,515 B2
(45) Date of Patent: Nov. 7, 2006

(54) COMPACT DESCENT CONTROLLER

(75) Inventors: Yakov Gartsbeyn, East Longmeadow, MA (US); Michael Gibbs, Enfield, CT (US); Sally A. Baumann, Avon, CT (US)

(73) Assignee: Tech Safety Lines, Inc., Dallas, TX (US)

( * ) Notice: Subject to any disclaimer, the term of this patent is extended or adjusted under 35 U.S.C. 154(b) by 0 days.

(21) Appl. No.: 10/771,492

(22) Filed: Feb. 4, 2004

(65) Prior Publication Data

US 2004/0231923 A1 Nov. 25, 2004

Related U.S. Application Data

(63) Continuation-in-part of application No. 10/251,090, filed on Sep. 20, 2002, now abandoned.

(60) Provisional application No. 60/324,756, filed on Sep. 25, 2001.

(51) Int. Cl.
*A62B 1/16* (2006.01)

(52) U.S. Cl. ..... 182/192; 182/5

(58) Field of Classification Search ..... 182/5, 182/192, 193; 188/65.4, 65.5
See application file for complete search history.

(56) References Cited

U.S. PATENT DOCUMENTS 3,335,469 A * 8/1967 Shand et al. ..... 188/65.1
3,949,832 A * 4/1976 Hunter ..... 182/7
4,040,627 A * 8/1977 Useldinger ..... 482/120
4,474,262 A * 10/1984 Himmelrich ..... 182/5
5,131,491 A * 7/1992 Varner et al. ..... 182/7

* cited by examiner

*Primary Examiner*—Alvin Chin-Shue
(74) *Attorney, Agent, or Firm*—Scott L. Harper; Carstens & Cahoon, LLP

(57) ABSTRACT

A load lowering descent controller having a fixed cylindrical body or capstan about which a rope or cable is turned. The descent controller allows for lowering of the load at a controlled rate by adjusting the amount of friction between the controller and the rope or cable as a function of rope or cable turning and relative contact with rope or cable engagement surfaces in the controller.

18 Claims, 6 Drawing Sheets

COMPACT DESCENT CONTROLLER

REFERENCE TO RELATED APPLICATIONS

The present application is a continuation in part application of U.S. patent application Ser. No. 10/251,090, filed Sep. 20, 2002 now abandoned, which claims benefit of U.S. Provisional Patent Application No. 60/324,756 filed Sep. 25, 2001, the contents of each of which are incorporated by reference herein.

BACKGROUND OF THE INVENTION

The present invention relates to a descent controller for use on a rope or line or cable for lowering a person or load in a controlled descent from a higher elevation to a lower elevation. More particularly, the present invention relates to a rope or cable mounted descent control device having a compact design and wherein the operating components are substantially enclosed.

Numerous descent assistance devices have been developed, all with the objective of aiding in the lowering of a load from a higher to a lower elevation. These devices have taken many forms and have utilized a variety of elements capable of providing a mechanical advantage together with a braking mechanism. In more recent years, concerns with occupational safety have led to the development of mechanisms that enable a worker to lower himself from an elevated position such as a scaffold, crane, lift truck or platform in the event of an emergency.

A descent control device with a deadman brake, in the form of a vertical cylindrical drum or capstan about which a rope is wound and a tapered slot through the drum for receiving and releasably gripping the rope along which descent is made, together with a releasable locking end plate, is shown in U.S. Pat. No. 5,131,491, issued Jul. 21, 1992, to H. M. Varner and R. H. Frost. While the above device is well designed and effective, it is desirable in some applications to reduce overall size and number of operating components. It is also desirable to enclose the operational components in some applications to lessen the potential for contamination or damage.

SUMMARY OF THE INVENTION

It is an object of the present invention to provide a new and improved load lowering descent controller of the type embodying a fixed cylindrical body or capstan about which a rope or cable is turned.

Another object of the present invention is to provide a descent controller of the foregoing character that may be actuated for lowering a load such as an unconscious user or equipment.

A further object of the present invention is to provide a descent controller of the foregoing character having a compact and robust design.

Still another object of the present invention is to provide a descent controller wherein the operating components are substantially enclosed.

A further object of the present invention is to provide a descent controller having the foregoing characteristics, which enables the user to adjust the mechanical advantage of the device.

Briefly, one embodiment of the present invention comprises an improved descent controller for lowering a load along a rope from an elevated position to a relatively lower position. The controller comprises a housing having a friction cylinder or capstan of a length adapted to receive a plurality of turns of the rope wrapped therearound. The housing has an upper end portion and a lower end portion, with top and bottom end plates attached respectively adjacent the upper end portion and spaced from the lower end portion of the housing. The lower end portion has a transverse through aperture connecting to a generally longitudinal aperture. The top end plate has a portion thereof overhanging the cylinder and defining radial slots sized to loosely receive the rope. The housing defines a longitudinal counterbore intersecting the transverse through aperture at the housing lower end portion. An elongated aperture extends transversely through the housing upper end portion and intersects the counterbore.

A plunger comprises a bottom portion disposed within the housing counterbore and a top portion disposed adjacent the housing top plate. The plunger may include an intermediate portion having a diameter between the diameter of the bottom and top portions. The bottom portion of the plunger extends below the lower end plate and defines diametrically therethrough a downwardly narrowing tapered slot. The tapered slot defines an enlarged end adapted to freely admit the rope and tapers from the enlarged end to a relatively constricted end of a width sufficient for gripping the rope.

A bias member is disposed within the counterbore and between the plunger bottom portion and the housing. The bias member urges the plunger toward a position for wedging the rope in the narrow end of the tapered slot. An outer sleeve is secured to the plunger top portion for use in sliding the plunger against the force of the biasing spring to release the rope from the narrow end of the tapered slot. The sleeve defines a housing substantially enclosing the plunger, spring, friction cylinder and the rope wrapped therearound. The lower portion of the sleeve may also include a longitudinally extending slot therein of sufficient width for freely receiving the rope.

Means are provided on the lower end of the housing for engagement with a load support. The descent controller supports a load on the rope and, upon sliding movement of the sleeve, provides for a controlled descent of descent controller and the supported load along the rope.

In another aspect of the invention the controller can be secured at an elevated position and actuated at that point to lower a rope-supported load.

The present invention provides a descent controller that substantially encloses all of the working components. Additionally, the inventive descent controller uses parts that are robust in construction while requiring only a fraction of the length of some known controllers.

BRIEF DESCRIPTION OF THE DRAWINGS

Other objects and advantages of the invention will be evident to one of ordinary skill in the art from the following detailed description may with reference to the accompanying drawings, in which.

DETAILED DESCRIPTION

Figure 3:
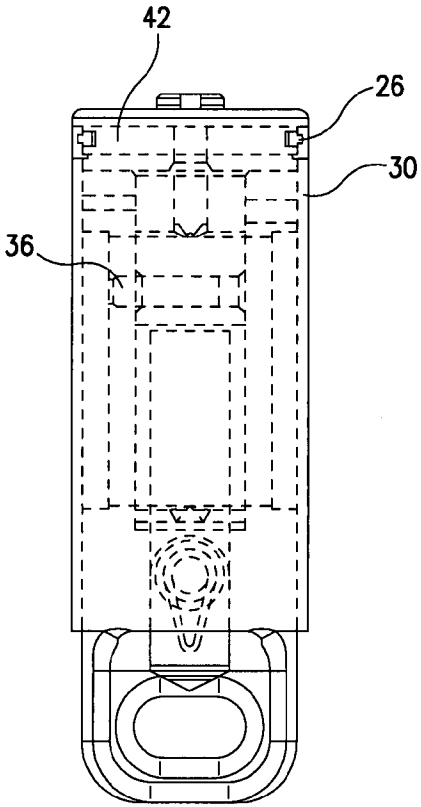
FIG. 3 is a side view showing the descent controller of FIG. 2 in a different rotational orientation.
Figure 2:
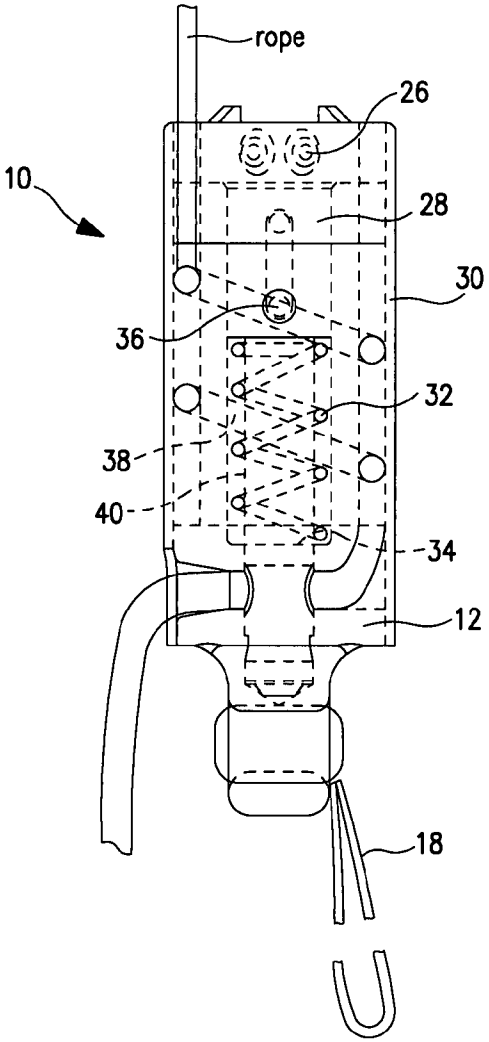
FIG. 2 is side view, partly in phantom and partly in section, of an embodiment of an inventive descent controller.
Figure 7:
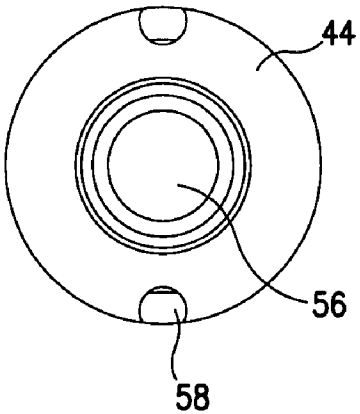
FIG. 7 is a bottom view of the housing of FIG. 5.
Figure 8:
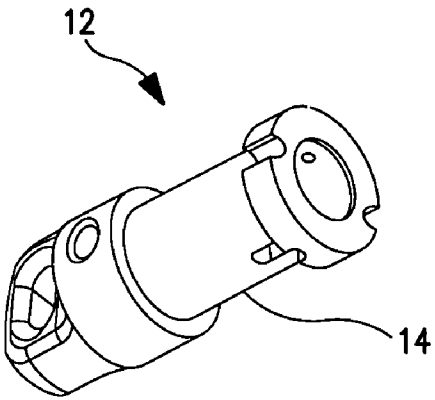
FIG. 8 is a perspective view of the housing of FIG. 5.
Figure 5:
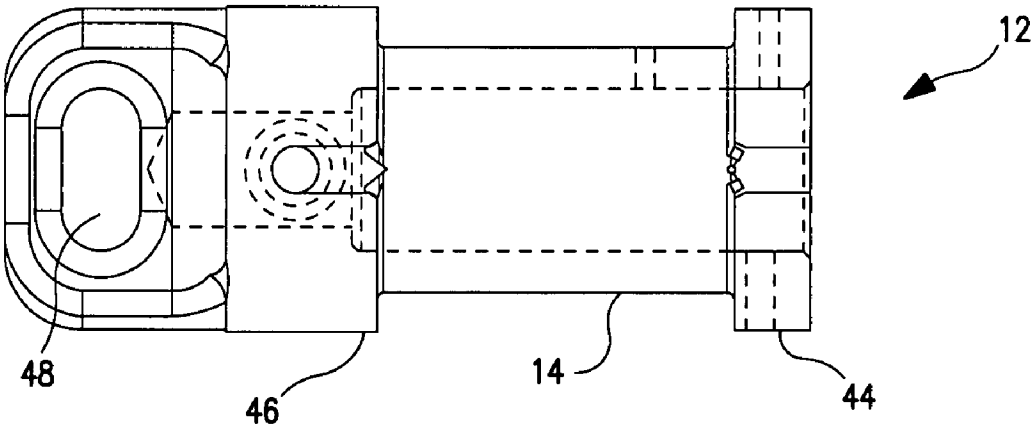
FIG. 5 is a side view, partly in phantom, of an embodiment of an inventive housing.
Figure 6:
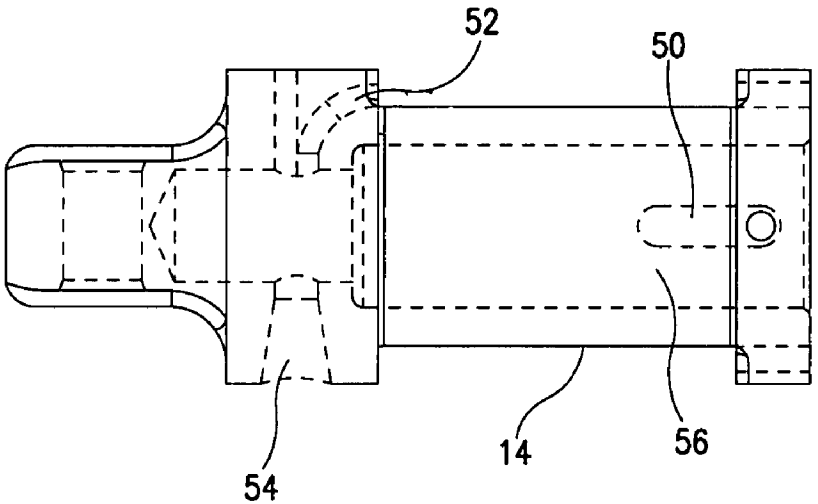
FIG. 6 is a side view showing the housing of FIG. 5 in a different rotational orientation.
Figure 9:
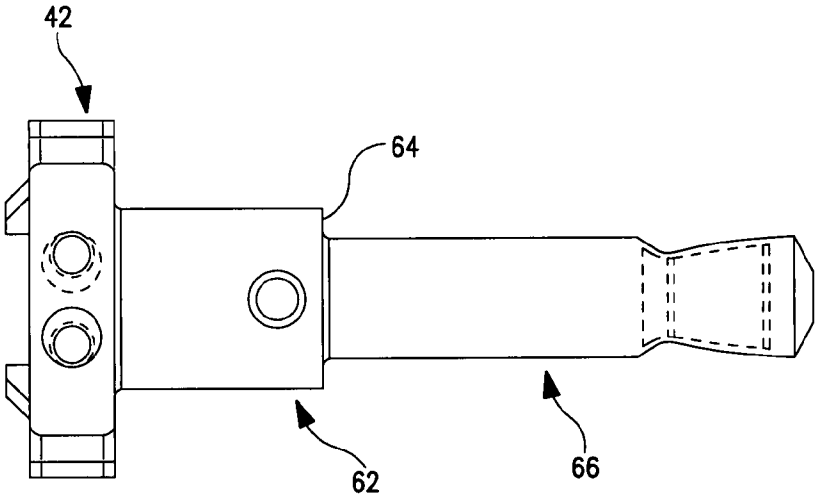
FIG. 9 is a side view, partly in phantom, of an embodiment of an inventive plunger.
Figure 10:
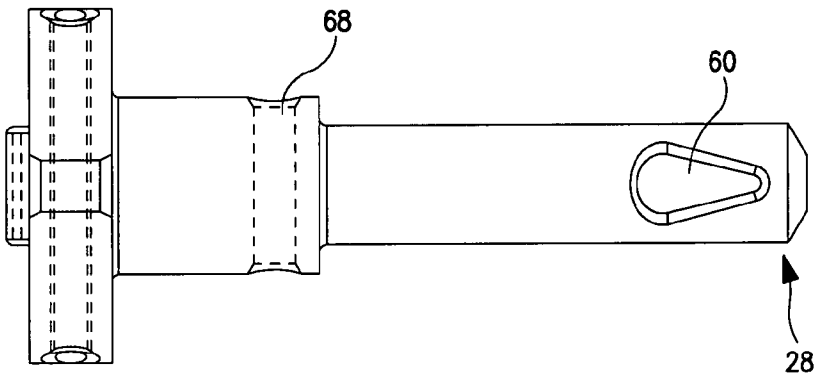
FIG. 10 is a side view showing the plunger of FIG. 9 in a different rotational orientation.
Figure 11:
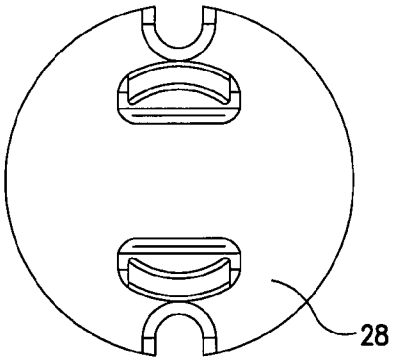
FIG. 11 is a top view of the plunger of FIG. 9.
Figure 12:
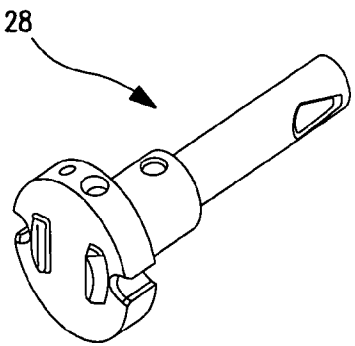
FIG. 12 is a perspective view of the plunger of FIG. 9.

One embodiment of a descent controller 10 of the present invention is shown in FIGS. 2 and 3. The descent controller comprises a housing 12 (shown best in FIGS. 5–8) including a longitudinally oriented capstan 14 such as a cylinder shaft or drum about which a length of rope or line 16 is wound. The number of turns of rope is the principal determinate of the capstan ratio or mechanical advantage enabling the user or load to descend slowly along the fixed rope as the rope hangs from the elevated point. A user can change the number of turns of rope wound around the capstan to change the mechanical advantage and thereby the descent speed. The rope is secured at one end at an elevated point (not shown) above the ground, and hangs downwardly to the ground or a lower platform (not shown). The descent controller is mounted on the rope to enable the descent controller and user or a load to descend slowly and controllably along the fixed length of rope from the elevated point to the lower point, whether the ground or a platform. The controller includes means for selectively gripping the rope to slow or prevent descent and for selectively releasing the rope to provide for a controlled descent. In a first extreme position or deadman position, the controller grips the rope tightly and prevents descent. In some embodiments the opposite extreme position comprises a complete release position wherein the rope is released at a rate limited by the weight of the load and the number of turns of rope wrapped around the capstan or friction cylinder. Between the opposing positions, the rope is released at a user-controlled rate.

The housing includes a top plate 44 adjacent an upper end portion and a bottom portion comprising a bottom plate 46 adjacent a lower end of the capstan. Juxtaposed with the bottom portion of the housing is means for receiving a strap 48, supporting rope, hook, loop, carabiner or the like for engaging and supporting a load suspension structure or harness. The housing can be an integral structure.

The housing lower end portion defines a transverse through aperture 54 connecting to a longitudinal aperture 52, each sized for freely receiving a portion of the rope. The top plate includes at least one rope receiving guide notch defined therein for receiving an inserted portion of the rope.

The housing defines a longitudinal counterbore 56 substantially concentric with a center axis and intersecting the transverse through aperture at the housing lower end portion. Advantageously, the housing defines a diametrically smaller counterbore in the lower end portion and a diametrically larger counterbore in the intermediate and upper portions. The housing intermediate and upper portions define at least one longitudinally elongated aperture 50 intersecting the counterbore.

The housing intermediate and upper portions define a longitudinally elongated aperture. Advantageously, the housing defines a pair of diametrically opposed, longitudinally elongated apertures and at least one aperture extends transversely through the wall of the housing and intersects the counterbore.

A plunger 28 (shown best in FIGS. 9–12) comprises a bottom portion 66 disposed within the housing counterbore and a top portion 42 overlying the housing top plate. The plunger includes an intermediate portion 62 that may have a diameter between the diameter of the bottom and top portions. The plunger intermediate portion defines a diametrical aperture 68 therethrough. The plunger can be integral.

The housing is secured to the plunger by at least one stop pin 36 extending through the plunger diametrical aperture and housing longitudinally elongated aperture. See FIGS. 2 and 3. The stop pin and longitudinally elongated aperture combine to limit the plunger to only axial movement between the extreme raised and lowered positions.

In one embodiment the bottom portion of the plunger extends below the lower end plate and defines diametrically therethrough a narrowing tapered slot 60 having a generally teardrop shape. The slot tapers from an enlarged end that loosely receives the rope to a narrow or gripping end that frictionally grips the rope. A rope passing through the open end of the slot moves freely through the slot. However, the rope is tightly gripped and restrained by the narrower end of the slot. The housing transverse aperture positively positions the rope in the slot. The transverse aperture receives the rope and allows the rope to pass freely through the enlarged end of the tapered slot when the plunger is in a lowered position, as well as receiving the rope to force or jam the rope into the narrow end of the tapered slot when the plunger is in its upper position. While a downwardly narrowing tapered slot is preferred at the present time it should be understood that other slots having different configurations in which the rope is loosely received in one portion and restrained from passage in another portion are possible and all such configurations are encompassed by the invention. For example, the slot may have an enlarged central portion connecting opposing narrower portions in a general diamond shape.

The rope is inserted through the transverse through aperture and longitudinal aperture, wound in a number coils or turns about the capstan or friction cylinder between the bottom and top plates and disposed through the top plate guide notch.

A bias member functions to urge the plunger toward its rope gripping or deadman position wherein the narrower end of the slot is aligned with the housing transverse through aperture. In this position the slot narrow end restrains the rope from passing through the descent controller. The bias member can be, for example, a coil spring 32 disposed between an interior wall 38 of the counterbore and an outer surface 40 of the bottom portion of the plunger. Preferably, a lower end of the spring is supported by a thrust shoulder 34 in the housing lower end portion and an opposing upper end of the spring is supported by a plunger thrust shoulder 64 defined at the intersection of the plunger bottom and intermediate portions.

Figure 13:
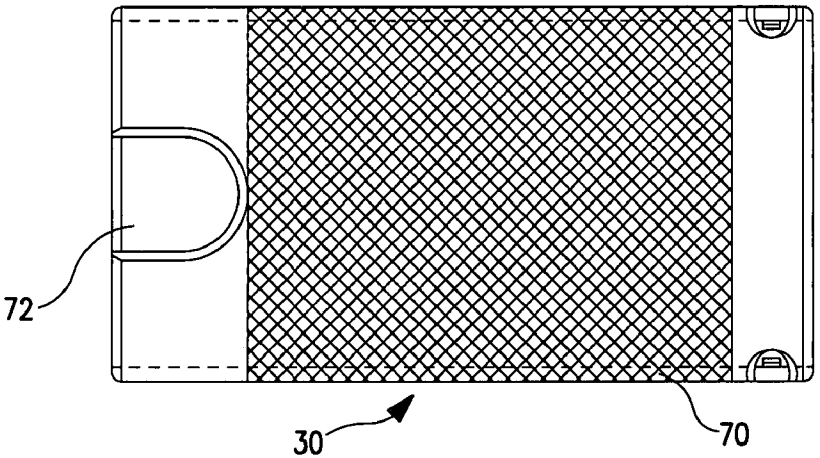
FIG. 13 is a side view, in phantom, of an embodiment of an inventive sleeve.
Figure 14:
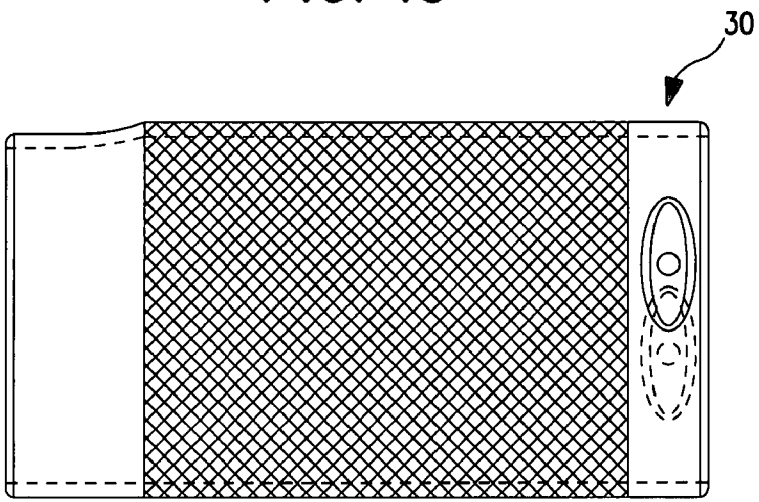
FIG. 14 is a side view showing the sleeve of FIG. 13 in a different rotational orientation.

A sleeve or housing 30 (shown best in FIGS. 13 and 14) is secured to the plunger top portion 42. As shown in FIGS. 2 and 3, the sleeve extends in surrounding covering relation with the plunger intermediate and lower portions, spring, capstan, rope turns, the housing upper and lower plates and some of the housing lower end portion. Advantageously, the sleeve is removably secured to the plunger top portion by, for example, ball detents 26 or threaded fasteners so that the sleeve can be removed to facilitate disassembly and reassembly of the descender. The sleeve is advantageously provided with a knurled, grooved or roughened outer surface 70 to enable a user to readily grip the housing surface without slipping, in order to actuate the plunger. Adjacent its lower edge the sleeve is provided with a longitudinally extending peripheral notch 72 which aligns with the housing transverse aperture and through which the rope loosely extends.

Since the sleeve is rotationally secured to the plunger and the plunger is rotationally secured to the housing by, for example, the stop pin, there is no tendency for the sleeve and/or plunger to rotate with respect to the capstan cylinder in this embodiment, thereby minimizing binding or jamming of the rope during descent.

In the event that a user completely releases the sleeve, e.g. a deadman fall, the spring will bias the plunger to a raised position so that the transverse aperture will jam the rope in the upper tapered end of the slot to prevent or retard further descent. The device can thus provide for a stop or controlled descent under deadman conditions.

Figure 16A:
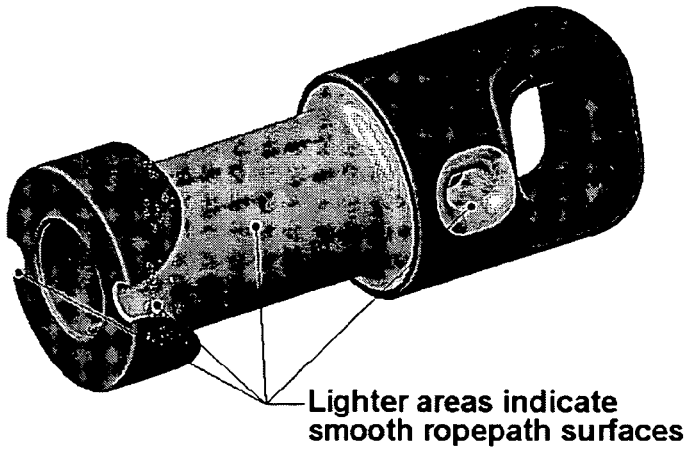
FIGS. 16*a* and 16*b* are perspective views of a housing indicating smoothly flowing rope path surfaces.
Figure 16B:
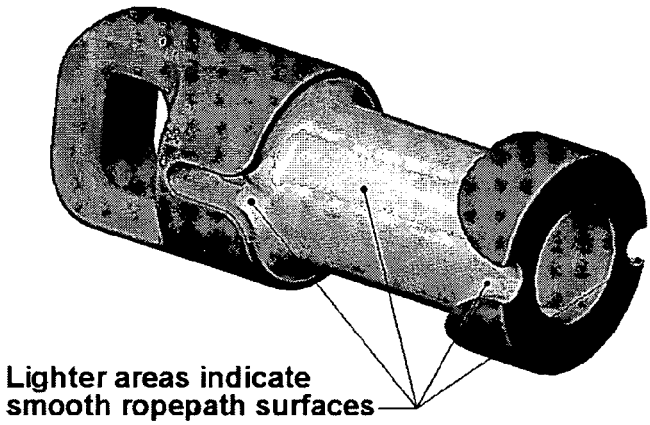
Figure 16C:
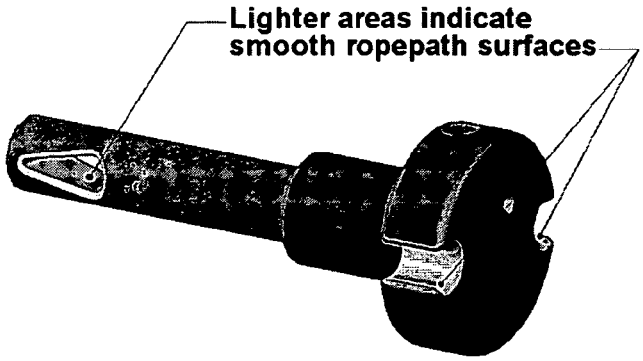
FIG. 16*c* is a perspective view of a plunger indicating smoothly flowing rope path surfaces.

In any embodiment the portions of the device in contact with the rope, such as aperture edges, can be polished or chamfered or rounded to reduce cutting of or damage to the rope. The rope path surfaces indicated by the lighter colored areas in FIGS. 16*a*–16*c* are surprisingly influential to rope wear and rope capacity. Preferably, the surfaces in these areas are smoothly flowing rope paths comprising inner radii of more than 1.2 times the rope radius, external radii of more than 3 times the rope radius and rope contact areas with no high spots or ledges. Ropes such as VECTRAN, 12 strand braided rope, available from The Cortland Companies and having a diameter of about 5 mm can be used with a descent controller having the preferred smoothly flowing rope paths. Surfaces in these areas that have an inner radius of less than 1 times the rope radius or an external radius of less than 3 times the rope radius or a high area or ledge may decrease the rope ultimate yield strength or carrying capacity by as much as 50 percent.

Figure 1:
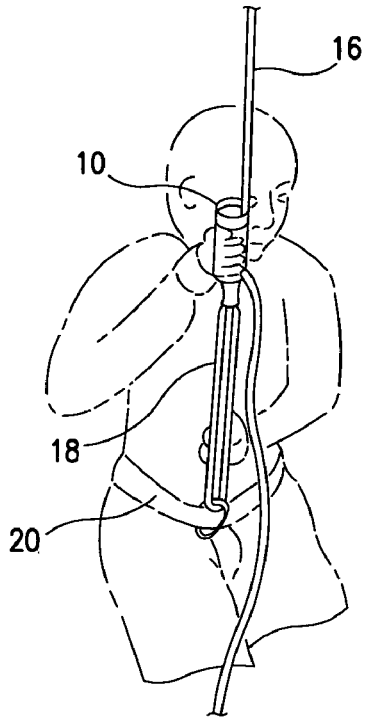
FIG. 1 is a perspective view illustrating use of an embodiment of an inventive descent controller.
Figure 15:
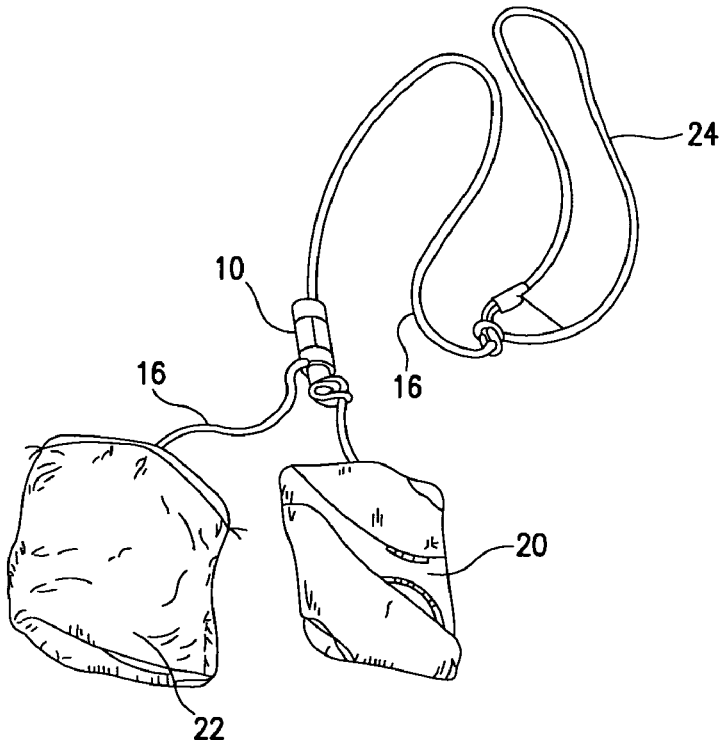
FIG. 15 is a perspective view of a portion of an emergency descent kit utilizing an inventive descent controller.
Figure 4:
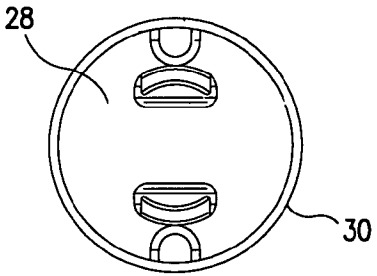
FIG. 4 is a top view of the descent controller of FIG. 2.

The present invention finds particular but not necessarily exclusive utility in safety escape systems, as shown in FIG. 15. Such an escape system includes a descent controller in association with a safety rope and a supporting harness 20 such as, for example, a harness of the type disclosed and claimed in U.S. Pat. No. 5,070,692, issued Dec. 10, 1991. At one end, the rope is provided with a loop 24 or other device to enable the rope to be secured at an elevated position. The free end of the rope is housed in a container 22. The rope container, descent controller, and harness are packaged in a kit containing appropriate instructions. In use, such as for a descent from a scaffold or lift truck platform, the kit is opened and the loop end of the rope is secured to a fixture at the elevated location. The rope packet is lowered so that the rope extends from the fixture to the ground. The user dons the harness, steps off of the platform and actuates the descent controller so that the descent controller and user descend along the rope to the ground.

Alternatively, for lowering an unconscious person or other load along a rope from an elevated position to a lowered position, the load can be secured to the loop end of the rope and the descent controller secured to a fixed mounting support by attaching the strap 18 thereto. An operator, at the position of the fixed descent controller can reach the sleeve to actuate the controller to control the descent of the load in the harness. The free end of the rope feeds through the controller as the load descends.

A further alternative use of a descent controller embodying the present invention, is for controlling the descent of work stations, such as a bosun's chair, while the rider is working on a vertical surface. The user secures the descent controller to the bosun's chair and descends to a working position. At the working position the sleeve is released, thereby stopping the descent, and enabling the user to perform a task at the working position. When the task at that location is finished, the user can descend to a lower position and continue the work. The descent is controlled by actuating the sleeve of the descent controller to provide for a controlled descent. For additional safety, the user also conventionally employs a separate, secured safety rope (not shown), to prevent accidental descent or catch the user and prevent a fall.

The foregoing descent controller provides a user controllable means for a person located above the ground or floor to descend thereto on a rope. Applications include but are not limited to egress from overhead crane cabs, forklift or stockpicker cabs, and the buckets on high-lift utility vehicles. In addition, the device may be used for the evacuation of buildings, bridges, structures, platforms, ships, or aircraft where the descent distance is sufficient to cause injury if the user jumps without a control device. Another application is for the rescue of persons trapped in a building by fire, stranded on a ledge or a mountain, or in similar hazardous situations. Police special weapons teams and armed forces personnel can use the device effectively for controlled descent from buildings, ledges, mountains, aircraft and other elevated positions.

While certain illustrative embodiments have been shown in the drawings and described above in considerable detail it should be understood that there is no intention to limit the invention to the specific forms disclosed. On the contrary the intention is to cover all modifications, alternative constructions, equivalents and uses falling within the spirit and scope of the invention as expressed in the appended claims.

What is claimed is:

1. A descent controller, comprising:

a housing for providing a nonlinear rope path extending from one longitudinal end of the housing to the other end, the housing substantially enclosing a longitudinal capstan portion and the longitudinal capstan portion defining a longitudinal counterbore therein;

a plunger disposed within the counterbore for movement between a rope releasing position and a rope gripping position, the plunger including a transverse through aperture for selectively narrowing the rope path; and a biasing member substantially disposed within the counterbore for biasing the plunger toward the rope gripping position, wherein the plunger is concentric with the housing.

2. The descent controller of claim 1 wherein the housing substantially encloses the plunger and the spring mechanism.

3. The descent controller of claim 1, wherein the nonlinear rope path encircles the capstan portion.

4. The descent controller of claim 1, wherein the transverse through aperture for selectively narrowing the rope path is within a bottom portion of the plunger.

5. The descent controller of claim 1 further comprising:

a rope; and wherein the housing and the plunger define a rope path having inner radii of more than 1.2 times the rope radius, external radii of more than 3 times the rope radius and having substantially no high spots or ledges.

6. The descent controller of claim 1, wherein the housing includes a lower end portion defining a transverse aperture and the nonlinear rope path proceeds through the transverse aperture and encircles the capstan portion.

7. The descent controller of claim 1, wherein the housing is enclosed and wherein the housing and the plunger have a fixed rotational orientation.

8. A controller for selectively gripping and releasing a rope, comprising:

a housing having a longitudinal capstan portion and defining a longitudinal counterbore therein;

a plunger including a bottom portion disposed within the counterbore for movement between a first position wherein the rope is gripped and a second position wherein the rope is released; and a biasing member disposed within the counterbore for urging the plunger toward the first position, wherein the plunger bottom portion defines a downwardly narrowing tapered lot extending diametrically therethrough.

9. The controller of claim 8, wherein the plunger defines a thrust shoulder, the housing defines a thrust shoulder and the biasing member contacts both the plunger thrust shoulder and the housing thrust shoulder.

10. The controller of claim 8, wherein the housing includes means for attaching a load or a mounting support.

11. A controller for selectively gripping and releasing a rope, comprising:

a housing having a longitudinal capstan portion and defining a longitudinal counterbore therein;

a plunger including a bottom portion disposed within the counterbore for movement between a first position wherein the rope is gripped and a second position wherein the rope is released wherein the plunger bottom portion defines a downwardly narrowing tapered slot extending diametrically therethrough, the housing includes a lower end portion defining a transverse aperture connecting to a generally longitudinal aperture, the transverse aperture intersecting the longitudinal counterbore, the controller defining a rope path through the transverse aperture, the tapered slot, the generally longitudinal aperture and encircling the capstan portion; and a biasing member disposed within the counterbore for urging the plunger toward the first position.

12. The controller of claim 11, wherein the housing includes means for attaching a load or a mounting support.

13. A controller for selectively gripping and releasing a rope, comprising:

a housing having a longitudinal capstan portion and defining a longitudinal counterbore a plunger including a bottom portion disposed within the counterbore for movement between a first position wherein the rope is gripped and a second position wherein the rope is released; and, a biasing member disposed within the counterbore for urging the plunger toward the first position; and, wherein the housing includes a top plate and the plunger includes a top portion overlying the top plate.

14. A controller for selectively gripping and releasing a rope, comprising:

a housing having a longitudinal capstan portion and defining a longitudinal counterbore therein, wherein the housing includes an external surface and defines a longitudinally elongated aperture extending between the external surface and the counterbore;

a plunger defining a transverse aperture therethrough, including a pin disposed in the elongated aperture and the transverse aperture, the pin and elongated aperture limiting movement of the plunger to axial motion within the range between a first and a second positions;

the plunger including a bottom portion disposed within the counterbore for movement between the first position wherein a rope is gripped and the second position wherein the rope is released; and a biasing member disposed within the counterbore for urging the plunger toward the first position.

15. A controller for selectively gripping and releasing a rope, comprising:

a housing having a longitudinal capstan portion and defining a longitudinal counterbore therein;

a plunger including a bottom portion disposed within the counterbore for movement between a first position wherein the rope is gripped and a second position wherein the rope is released; and a biasing member disposed within the counterbore for urging the plunger toward the first position; and, wherein the plunger includes a top portion having two radially spaced stops projecting therefrom, the housing includes a lower end portion defining an attachment point, and a strap is selectively connectable to the attachment point and placeable intermediate the stops to maintain the plunger between the first and second positions.

16. A controller for selectively gripping and releasing a rope, comprising:

a housing having a longitudinal capstan portion and defining a longitudinal counterbore therein;

a plunger including a bottom portion disposed within the counterbore for movement between a first position wherein the rope is gripped and a second position wherein the rope is released; and a biasing member disposed within the counterbore for urging the plunger toward the first position; and, wherein the housing includes a top plate defining a first aperture radially spaced from the counterbore and the plunger includes a top portion overlying the top plate, the top portion defining a second aperture angularly alignable with the first aperture.

17. A manually actuated controller for lowering a rope supported load from an elevated position to a relatively lower position, comprising:

a housing having a longitudinal axis and defining a counterbore concentric with the axis, the housing having a lower end portion defining a generally diametrical aperture intersecting the counterbore and a generally longitudinal aperture intersecting the diametrical aperture, an opposing top plate defining a radial slot therein and a cylindrically shaped intermediate portion disposed between the top plate and the lower end portion;

a plunger having a bottom portion and an intermediate portion both disposed in the counterbore and a top portion overlying the top plate, the top portion defining a radial slot in angular alignment with the top plate slot, the plunger bottom portion defining a tapered slot extending diametrically therethrough, the slot tapering from an enlarged end to a narrowed end and at least a portion of the tapered slot in radial alignment with the diametrical aperture;

means for limiting the plunger movement within the counterbore;

a spring disposed within the counterbore and radially between the plunger bottom portion and the housing, the spring biasing the tapered slot narrowed end toward radial alignment with the diametrical aperture; and a sleeve enclosing the spring, the limiting means, the plunger, the housing top plate and the housing intermediate portion and connected to the plunger for movement thereof;

wherein a rope path is defined through the diametrical aperture, the tapered slot, the generally longitudinal aperture, multiply encircling the housing intermediate portion and through the top plate radial slot and the top portion radial slot.

18. The controller of claim 17, wherein the counterbore comprises a smaller diameter in the housing bottom portion and a larger diameter in the housing intermediate portion and wherein the plunger bottom portion comprises a smaller diameter than the plunger intermediate portion.

* * * * *